US007602354B2

(12) United States Patent
Kim

(10) Patent No.: US 7,602,354 B2
(45) Date of Patent: Oct. 13, 2009

(54) PLASMA DISPLAY PANEL (PDP) AND DRIVING METHOD THEREOF

(75) Inventor: Myoung-Kwan Kim, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 893 days.

(21) Appl. No.: 11/138,309

(22) Filed: May 27, 2005

(65) Prior Publication Data

US 2006/0028887 A1 Feb. 9, 2006

(30) Foreign Application Priority Data

Aug. 3, 2004 (KR) ..... 10-2004-0061139

(51) Int. Cl.
*G09G 3/28* (2006.01)

(52) U.S. Cl. ..... 345/60; 345/65; 315/169.4

(58) Field of Classification Search ..... 345/60, 345/65, 67; 315/169.4, 169.1, 169.3; 365/204; 313/582, 584; 348/742
See application file for complete search history.

(56) References Cited

U.S. PATENT DOCUMENTS

| | | | |
|---|---|---|---|
| 5,541,618 | A | 7/1996 | Shinoda |
| 5,661,500 | A | 8/1997 | Shinoda et al. |
| 5,663,741 | A | 9/1997 | Kanazawa |
| 5,674,553 | A | 10/1997 | Sinoda et al. |
| 5,724,054 | A | 3/1998 | Shinoda |
| 5,786,794 | A | 7/1998 | Kishi et al. |
| 5,952,782 | A | 9/1999 | Nanto |
| RE37,444 | E | 11/2001 | Kanazawa |
| 6,630,916 | B1 | 10/2003 | Shinoda |
| 6,707,436 | B2 | 3/2004 | Setoguchi et al. |
| 7,133,007 | B2 * | 11/2006 | Shinoda et al. ..... 345/60 |

FOREIGN PATENT DOCUMENTS

| | | |
|---|---|---|
| CN | 1213120 | 4/1999 |
| JP | 02-148645 | 6/1990 |
| JP | 08-305319 | 11/1996 |
| JP | 10-187090 | 7/1998 |
| JP | 10-198304 | 7/1998 |
| JP | 2845183 | 10/1998 |
| JP | 2917279 | 4/1999 |
| JP | 2001-043804 | 2/2001 |

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Abbas I Abdulselam
(74) *Attorney, Agent, or Firm*—Robert E. Bushnell, Esq.

(57) ABSTRACT

In a Plasma Display Device (PDP) and driving method thereof to reduce Electro Magnetic Interference (EMI), address electrodes are divided according to colors controlled by the address electrodes in the address period and voltages are supplied to the electrodes at different times to reduce EMI, and red, green, and blue discharge cells are controlled to concurrently emit light to display natural colors clearly.

19 Claims, 4 Drawing Sheets

FOREIGN PATENT DOCUMENTS

| | | |
|---|---|---|
| JP | 2001-325888 | 11/2001 |
| JP | 2002-140031 | 5/2002 |
| JP | 2002-251165 | 9/2002 |
| JP | 2005-037787 | 2/2005 |
| JP | 2005-070488 | 3/2005 |
| JP | 2005-121995 | 5/2005 |

* cited by examiner

PLASMA DISPLAY PANEL (PDP) AND DRIVING METHOD THEREOF

CLAIM OF PRIORITY

This application makes reference to, incorporates the same herein, and claims all benefits accruing under 35 U.S.C. §119 from an application for PLASMA DISPLAY DEVICE AND DRIVING METHOD THEREOF earlier filed in the Korean Intellectual Property Office on Aug. 3, 2004 and there duly assigned Serial No. 10-2004-0061139.

BACKGROUND OF THE INVENTION

1. Field of the Invention

The present invention relates to a Plasma Display Panel (PDP) and driving method thereof, and more particularly, to a PDP and driving method thereof to identify address electrodes by colors and to differently start the supplying of voltage in an address period to reduce ElectroMagnetic Interference (EMI).

2. Description of the Related Art

Recently, flat panel displays such as Liquid Crystal Displays (Lcds), Field Emission Displays (FEDs), and PDPs have been actively developed. The PDPs are advantageous over the other flat panel displays in regard to their high luminance, high luminous efficiency, and wide viewing angle. Accordingly, the PDPs are being highlighted as substitutes for conventional cathode ray tubes (CRTs) for large-screen displays of more than 40 inches.

Electrodes of a PDP are in a matrix format, and in detail, the PDP has address electrodes in the column direction, and scan electrodes and sustain electrodes in the row direction. A discharge space at a point where an address electrode crosses the scan and sustain electrodes forms a discharge cell.

The above-noted PDP is driven according to a reset period, an address period, and a sustain period with respect to time. In the reset period, the discharge cells are reset in order to stably perform an address operation on the discharge cells. In the address period, an address voltage is supplied to the discharge cells that are to be turned on (i.e., the addressed discharge cells) to accumulate wall charges on the discharge cells so as to select the discharge cells that are to be turned on and the discharge cells that are not to be turned on. In the sustain period, a discharge for actually displaying images on the addressed discharge cells is performed by supplying a sustain pulse.

In general, a scan voltage of Vscan is supplied to the scan electrodes sequentially in an address period. When the scan voltage is supplied to one scan electrode, an address voltage is selectively supplied to the address electrodes to address desired discharge cells. In a sustain period, a sustain pulse is supplied to the scan electrodes and the sustain electrodes to discharge the addressed discharge cells and display images.

A discharge cell generally displays one of Red, Green, and Blue (RGB) colors. The address electrodes respectively manage one of the RGB colors. A scan voltage of Vscan is supplied to the scan electrode and an address voltage of Va is concurrently supplied to the address electrode in the address period. In this instance, discharge cells are not addressed as soon as the scan voltage of Vscan and the address voltage of Va are supplied to the scan and address electrodes, but the discharge cells are discharged after a discharge delay time to emit light and be addressed while the scan voltage of Vscan and the address voltage of Va are supplied to the scan and address electrodes. The discharge time is different for each discharge cell for displaying RGB.

In general, the discharge delay by a discharge cell with a green phosphor is the longest, the discharge delay by a discharge cell with a red phosphor is next to the longest, and the discharge delay by a discharge cell with a blue phosphor is relatively the shortest.

The above-noted addressing method generates EMI because voltages are concurrently supplied to many electrodes, and the discharge cells are not discharged at the same time because discharge delays of the discharge cells representing red, green, and blue are different, and hence, no red, green, and blue light is emitted concurrently so that it is difficult to display natural color at a pixel.

The information provided above is only for enhancement of understanding of the background of the invention, and therefore, unless explicitly described to the contrary, it should not be taken as an acknowledgement or any form of suggestion that this information forms the prior art that is already known in this country to a person of ordinary skill in the art.

SUMMARY OF THE INVENTION

The present invention provides a PDP and driving method thereof having advantages of supplying voltages to address electrodes in different times according to address electrode colors to reduce EMI in an address period, and controlling red, green, and blue discharge cells to concurrently emit light and display natural colors.

In accordance with one aspect of the present invention, a method of driving a Plasma Display Panel (PDP) including a plurality of first and second electrodes, and a plurality of third electrodes crossing the first and the second electrodes, wherein the first, second, and third electrodes form discharge cells to emit colors is provided, the method comprising: supplying a first voltage to the first electrode; supplying a second voltage greater than the first voltage to a third electrode corresponding to a first color while supplying the first voltage to the first electrode; and supplying a third voltage greater than the first voltage to a third electrode corresponding to a second color after the second voltage has been supplied to the third electrode while supplying the first voltage to the first electrode; wherein the first, second, and third voltages are supplied in each address period.

The method preferably further comprises supplying a fourth voltage greater than the first voltage to a third electrode corresponding to a third color while supplying the first voltage to the first electrode.

A termination time of supplying the second voltage to the third electrode corresponding to the first color preferably coincides with a termination time of supplying the third voltage to the third electrode corresponding to the second color.

A termination time of supplying the second voltage to the third electrode corresponding to the first color is alternatively preferably after a termination time of supplying the third voltage to the third electrode corresponding to the second color.

Levels of the fourth voltage, the third voltage, and the second voltage are preferably equal.

A termination time of supplying the second voltage to the third electrode corresponding to the first color, a termination time of supplying the third voltage to the third electrode corresponding to the second color, and a termination time of supplying the fourth voltage to the third electrode corresponding to the third color preferably coincide.

A termination order of the second voltage supplied to the third electrode corresponding to the first color, the third voltage supplied to the third electrode corresponding to the second color, and the fourth voltage supplied to the third electrode corresponding to the third color is preferably in the order of the fourth voltage, the third voltage, and the second voltage.

The first color is preferably controlled by a discharge cell having the longest discharge delay.

The first color is preferably green.

The third color is preferably controlled by a discharge cell having the shortest discharge delay.

The third color is preferably blue.

In accordance with another aspect of the present invention, a Plasma Display Device (PDP) is provided comprising: a plasma panel including a plurality of discharge cells adapted to emit light and having a plurality of address electrodes and scan/sustain electrodes; a controller adapted to receive an image signal and to generate a control signal corresponding to the image signal; an address driver adapted to supply a voltage to the address electrode according to the control signal; and a scan/sustain electrode driver adapted to drive the scan and sustain electrodes according to the control signal; wherein the address driver supplies address voltages at different times according to address electrodes corresponding to colors of phosphors.

The address driver preferably comprises: a first driver adapted to supply a second voltage to an address electrode corresponding to a first color; a second driver adapted to supply a third voltage to an address electrode corresponding to a second color; and a third driver adapted to supply a fourth voltage to an address electrode corresponding to a third color.

Levels of the second voltage, the third voltage, and the fourth voltage are preferably equal.

Times for the first, second, and third drivers to terminate supplying voltages to the address electrodes preferably coincide.

The first color is preferably controlled by a discharge cell having the longest discharge delay.

The first color is preferably green.

The third color is preferably controlled by a discharge cell having the shortest discharge delay.

The third color is preferably blue.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Figure 1:
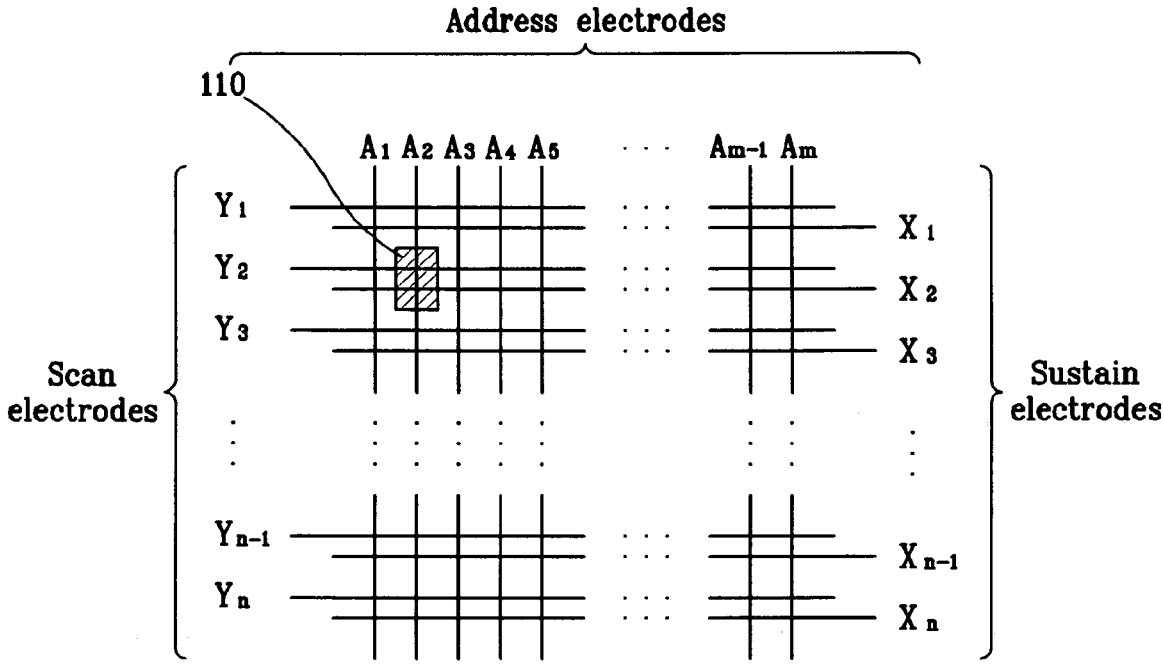
FIG. 1 is a view of an electrode arrangement diagram of a PDP.

FIG. 1 is a view of an electrode arrangement diagram of a PDP.

As shown in FIG. 1, electrodes of the PDP are in an m×n matrix format, and in detail, the PDP has address electrodes Al to Am in the column direction, and scan electrodes (Y electrodes) Y1 to Yn and sustain electrodes (X electrodes) X1 to Xn in the row direction. A discharge space at a point where the A electrode (A1-Am) crosses the X and Y electrodes (X1-Xn, Y1-Yn) forms a discharge cell 110.

The above-noted PDP is driven according to a reset period, an address period, and a sustain period with respect to time. In the reset period, the discharge cells are reset in order to stably perform an address operation on the discharge cells. In the address period, an address voltage is supplied to the discharge cells that are to be turned on (i.e., the addressed discharge cells) to accumulate wall charges on the discharge cells so as to select the discharge cells that are to be turned on and the discharge cells that are not to be turned on. In the sustain period, a discharge for actually displaying images on the addressed discharge cells is performed by supplying a sustain pulse.

In general, a scan voltage of Vscan is supplied to the Y electrodes in the order of from the Y electrode Y1 to the Y electrode Yn in an address period. When the scan voltage is supplied to one Y electrode, an address voltage is selectively supplied to the A electrodes A1 to Am to address desired discharge cells. In a sustain period, a sustain pulse is supplied to the Y electrodes Y1 to Yn and the X electrodes X1 to Xn to discharge the addressed discharge cells and display images.

Figure 2:
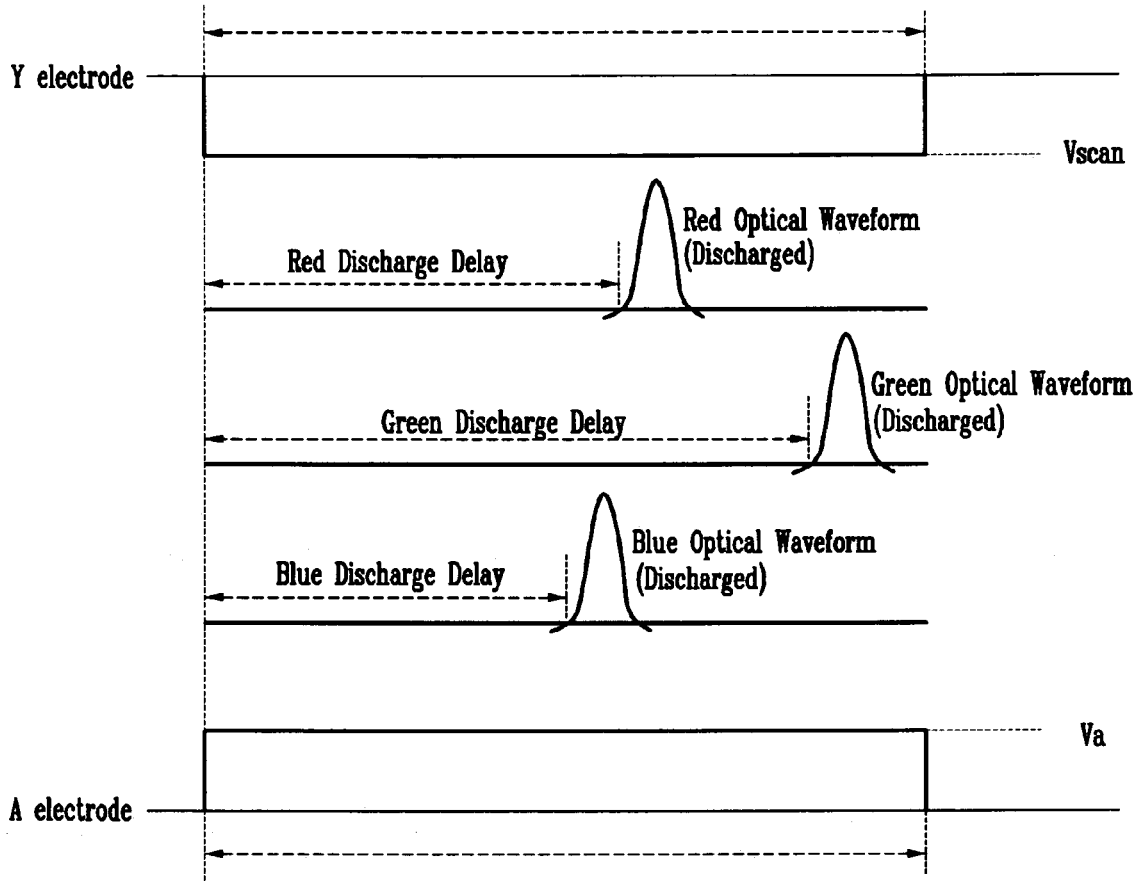
FIG. 2 a view of electrode driving waveforms of a PDP in an address period.

FIG. 2 a view of electrode driving waveforms of a PDP in an address period.

A discharge cell generally displays one of Red, Green, and Blue (RGB) colors. The A electrodes A1 to Am respectively manage one of the RGB colors. As shown in FIG. 2, a scan voltage of Vscan is supplied to the Y electrode and an address voltage of Va is concurrently supplied to the A electrode in the address period. In this instance, discharge cells are not addressed as soon as the scan voltage of Vscan and the address voltage of Va are supplied to the Y and A electrodes, but the discharge cells are discharged after a discharge delay time to emit light and be addressed while the scan voltage of Vscan and the address voltage of Va are supplied to the Y and A electrodes. The discharge time is different for each discharge cell for displaying RGB.

In general, the discharge delay by a discharge cell with a green phosphor is the longest, the discharge delay by a discharge cell with a red phosphor is next to the longest, and the discharge delay by a discharge cell with a blue phosphor is relatively the shortest.

The above-noted addressing method generates EMI because voltages are concurrently supplied to many electrodes, and the discharge cells are not discharged at the same time because discharge delays of the discharge cells representing red, green, and blue are different, and hence, no red, green, and blue light is emitted concurrently so that it is difficult to display natural color at a pixel.

In the following detailed description, exemplary embodiments of the present invention are shown and described, by way of illustration. As those skilled in the art would recognize, the described exemplary embodiments can be modified in various ways, all without departing from the spirit or scope of the present invention. Accordingly, the drawings and description are to be regarded as illustrative in nature, rather than restrictive. In the drawings, illustrations of elements having no relation with the present invention have been omitted in order to more clearly present the subject matter of the present invention. In the specification, the same or similar elements depicted in different drawings are denoted by the same reference numerals.

A PDP and driving method thereof according to an embodiment of the present invention is described in detail below with reference to FIG. 3 and FIG. 4.

Figure 3:
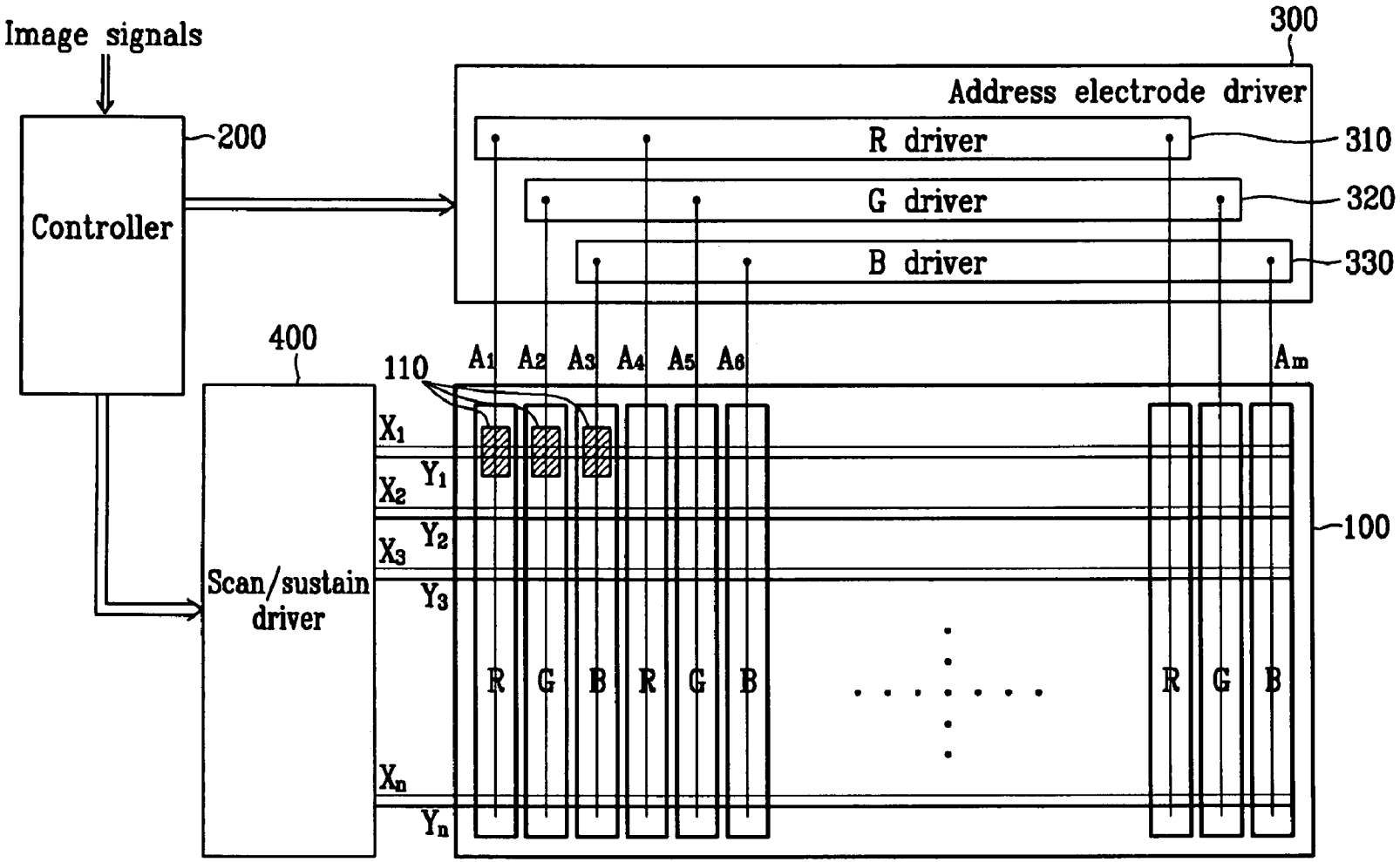
FIG. 3 is a diagram of a PDP according to an embodiment of the present invention.

FIG. 3 is a diagram of a PDP according to an embodiment of the present invention. As shown in FIG. 3, the PDP includes a plasma panel 100, a controller 200, an address driver 300, and a scan/sustain driver 400.

The plasma panel 100 includes a plurality of barrier ribs in the column direction. Red, green, and blue phosphors are arranged on the barrier ribs in a predetermined order. The plasma panel 100 includes a plurality of A electrodes A1 to Am in the column direction, and a plurality of X electrodes X1 to Xn and Y electrodes Y1 to Yn in the row direction on the barrier ribs. Discharge spaces 110 arranged at points where the A electrodes cross the X and Y electrodes form discharge cells, and each discharge cell represents one color.

The controller 200 receives an external image signal and outputs an A electrode driving signal, an X electrode driving signal, and a Y electrode driving signal. The address driver 300 receives an A electrode driving signal from the controller 200, and supplies a display data signal for selecting a discharge cell 110 to the A electrodes A1 to Am. The address driver 300 includes an R driver (a driver for driving the A electrode on the red phosphor) 310, a G driver (a driver for driving the A electrode on the green phosphor) 320 and a B driver (a driver for driving the A electrode on the blue phosphor) 330. The address driver 300 receives the A electrode driving signal from the controller 200 and transmits the signal to the R driver 310, the G driver 320, and the B driver 330.

In this instance, the R driver 310, the G driver 320, and the B driver 330 supply address voltages to the A electrodes according to the A electrode driving signals by differentiating the voltage application times. That is, the G driver 320 is initially driven to supply the address voltage to the A electrode formed on the green phosphor (referred to as an A_G electrode hereinafter) so as to prevent discharge failure of the green phosphor having the longest discharge delay.

The R driver 310 and the B driver 330 are then sequentially driven to supply address voltages to the A electrode formed on the red phosphor (referred to as an A_R electrode hereinafter) and the A electrode formed on the blue phosphor (referred to as an A_B electrode hereinafter). The scan/sustain driver 400 receives a Y electrode driving signal and an X electrode driving signal from the controller 200 and supplies a driving voltage to the Y electrodes and the X electrodes.

Figure 4:
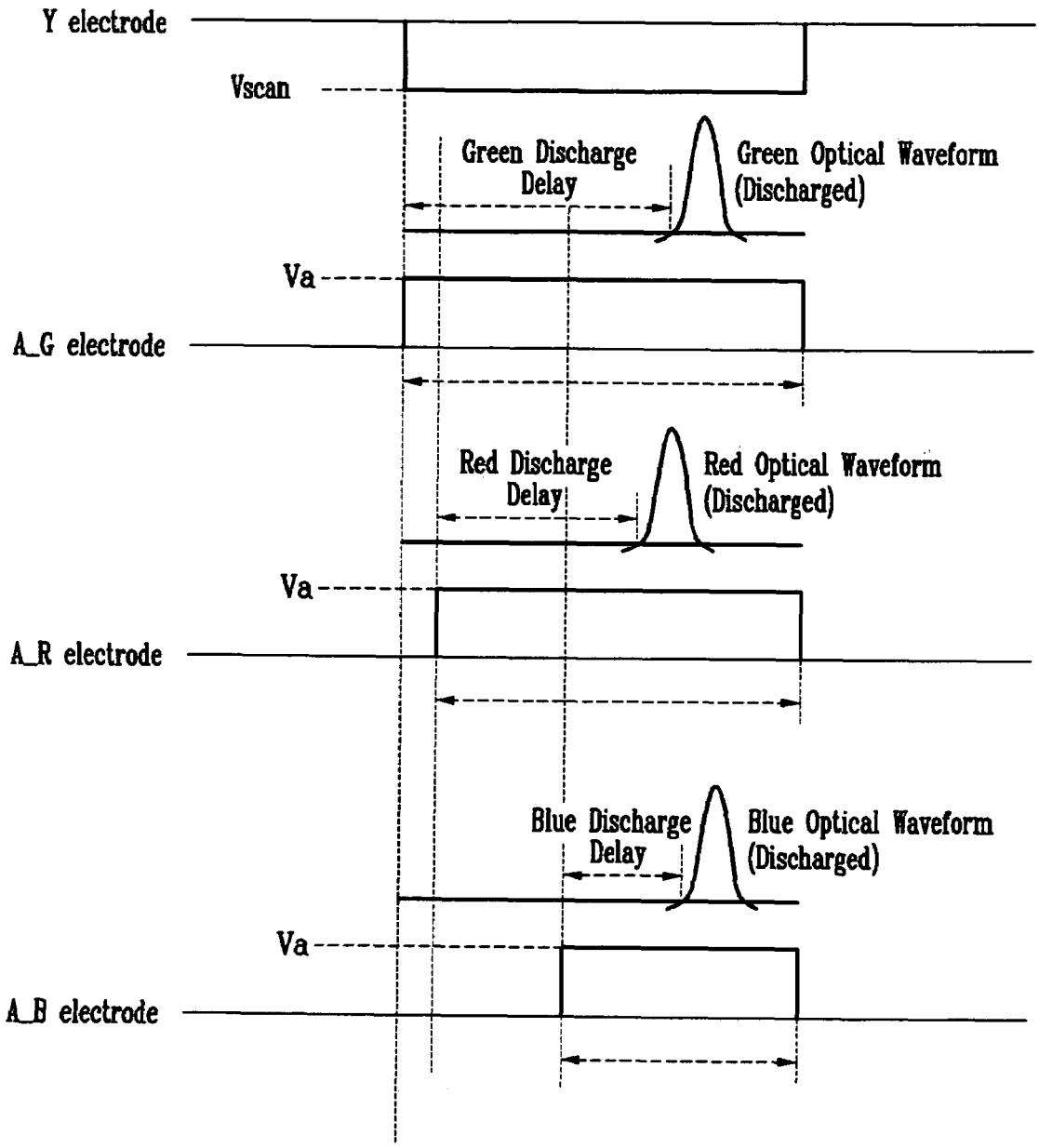
FIG. 4 a view of electrode driving waveforms of a PDP in an address period according to an embodiment of the present invention.

FIG. 4 a view of electrode driving waveforms of a PDP in an address period according to an embodiment of the present invention.

Referring to FIG. 4, a scan voltage of Vscan is supplied to a Y electrode (e.g., Y1), and the G driver 320 is driven to supply an address voltage of Va to the A_G electrode. The R driver 310 is driven to supply an address voltage of Va to the A_R electrode after a certain time, and the B driver 330 is driven to supply an address voltage of Va to the A_B electrode after a certain time. The voltages of Vscan and Va are no longer supplied to the Y and A electrodes when the discharge cells to be selected emit light. When the scan voltage is supplied to the Y electrode Y1 to address the discharge cell of the corresponding Y electrode Y1, the scan voltage is supplied to the residual Y electrodes Y2 to Yn on the plasma panel in a predetermined order to address the discharge cells.

In this instance, the discharge cells representing red, green, and blue can be controlled to concurrently emit light when the R driver 310, the G driver 320, and the B driver 330 are driven to control the time for supplying an address voltage to the A_R electrode, the A_G electrode, and the A_B electrode according to discharge delays of the red, green, and blue phosphors. For example, when the discharge delays of the R, G, and B phosphors are respectively 5, 7, and 3 ms, the G driver 320 is driven to supply an address voltage to the A_G electrode, the R driver 310 is driven to supply an address voltage to the A_R electrode after 2 ms, and the B driver 330 is driven to supply an address voltage to the A_B electrode after 2 ms, thereby allowing the R, G, and B phosphors to concurrently emit light.

Application of address voltages to the A electrodes is concurrently terminated when the discharge cells emit light, and further EMI can be reduced by differentiating termination times of supplying the address voltage to the A_R electrode, the A_G electrode, and the A_B electrode.

For example, when discharge delays of the R, G, and B phosphors are 5, 7, and 3 ms, the G driver 320 is driven at 0 ms, the R driver 310 is driven at 1 ms, and the B driver 330 is driven at 2 ms, the B phosphor emits light at 5 ms, the R phosphor emits light at 6 ms, and the G phosphor emits light at 7 ms. Therefore, the termination times on application of the address voltage are controlled to be different by terminating driving of the B driver 330 at 5 ms, that of the R driver 310 at 6 ms, and that of the G driver 320 at 7 ms. Also, the drivers are driven in the order of the G driver 320, the R driver 310, and the B driver 330 since the discharge delays are reduced in the order of the G, R, and B phosphors, and in addition, the application times of the address voltage can be varied when the order of lengths of the discharge delays is changed. For example, the drivers are driven in the order of the R driver 310, the G driver 320, and the B driver 330 when the discharge delays are shortened in the order of the R, G, and B phosphors.

While the present invention has been described in connection with what is presently considered to be practical exemplary embodiments, it is to be understood that the present invention is not limited to the disclosed embodiments, but, on the contrary, is intended to cover various modifications and equivalent arrangements included within the spirit and scope of the appended claims.

As described above, the voltages are supplied to the address electrodes at different times depending on the colors thereof to thereby reduce EMI, and the red, green, and blue discharge cells are controlled to concurrently emit light to thereby display natural colors in the PDP according to the embodiment of the present invention.

What is claimed is:

1. A method of driving a Plasma Display Panel (PDP) including a plurality of first and second electrodes, and a plurality of third electrodes crossing the first and the second electrodes, wherein the first, second, and third electrodes form discharge cells to emit colors, the method comprising:

supplying a first voltage to the first electrode;

supplying a second voltage greater than the first voltage to a third electrode corresponding to a first color while supplying the first voltage to the first electrode; and supplying a third voltage greater than the first voltage to a third electrode corresponding to a second color after the second voltage has been supplied to the third electrode while supplying the first voltage to the first electrode;

wherein the first, second, and third voltages are supplied in order in each address period.

2. The method of claim 1, further comprising supplying a fourth voltage greater than the first voltage to a third electrode corresponding to a third color while supplying the first voltage to the first electrode.

3. The method of claim 2, wherein levels of the fourth voltage, the third voltage, and the second voltage are equal.

4. The method of claim 2, wherein a termination time of supplying the second voltage to the third electrode corresponding to the first color, a termination time of supplying the third voltage to the third electrode corresponding to the second color, and a termination time of supplying the fourth voltage to the third electrode corresponding to the third color coincide.

5. The method of claim 2, wherein the second voltage supplied to the third electrode corresponding to the first color, the third voltage supplied to the third electrode corresponding to the second color, and the fourth voltage supplied to the third electrode corresponding to the third color are terminated in an order of the fourth voltage, the third voltage, and the second voltage.

6. The method of claim 1, wherein a termination time of supplying the second voltage to the third electrode corresponding to the first color coincides with a termination time of supplying the third voltage to the third electrode corresponding to the second color.

7. The method of claim 1, wherein the supplying of the second voltage to the third electrode corresponding to the first color is terminated after the supplying of the third voltage to the third electrode corresponding to the second color has been terminated.

8. The method of claim 1, wherein the first color is controlled by a discharge cell having the longest discharge delay.

9. The method of claim 8, wherein the first color is green.

10. The method of claim 8, wherein the third color is controlled by a discharge cell having the shortest discharge delay.

11. The method of claim 10, wherein the third color is blue.

12. A Plasma Display Device (PDP) comprising:

a plasma panel including a plurality of discharge cells adapted to emit light and having a plurality of address electrodes and scan/sustain electrodes;

a controller adapted to receive an image signal and to generate a control signal corresponding to the image signal;

an address driver adapted to supply a voltage to the address electrode according to the control signal; and a scan/sustain electrode driver adapted to drive the scan and sustain electrodes according to the control signal;

wherein the address driver supplies address voltages at different times according to address electrodes corresponding to colors of phosphors.

13. The PDP of claim 12, wherein the address driver comprises:

a first driver adapted to supply a second voltage to an address electrode corresponding to a first color;

a second driver adapted to supply a third voltage to an address electrode corresponding to a second color; and a third driver adapted to supply a fourth voltage to an address electrode corresponding to a third color.

14. The PDP of claim 13, wherein levels of the second voltage, the third voltage, and the fourth voltage are equal.

15. The PDP of claim 13, wherein times for the first, second, and third drivers to terminate supplying voltages to the address electrodes coincide.

16. The PDP of claim 15, wherein the first color is green.

17. The PDP of claim 15, wherein the third color is controlled by a discharge cell having the shortest discharge delay.

18. The PDP of claim 17, wherein the third color is blue.

19. The PDP of claim 13, wherein the first color is controlled by a discharge cell having the longest discharge delay.

* * * * *